US005288097A

United States Patent [19]

Pascal et al.

[11] Patent Number: 5,288,097

[45] Date of Patent: Feb. 22, 1994

[54] PROCESS FOR MANUFACTURING A SKI, AND A SKI MANUFACTURED BY THE PROCESS

[75] Inventors: Roger Pascal, Annecy le Vieux; Gilles Recher, Annecy, both of France

[73] Assignee: Salomon S.A., Chavanod, France

[21] Appl. No.: 876,031

[22] Filed: Apr. 30, 1992

Related U.S. Application Data

[62] Division of Ser. No. 158,925, Feb. 22, 1988, Pat. No. 5,183,618.

[30] Foreign Application Priority Data

Feb. 27, 1987 [FR] France ..... 87 03119
Sep. 23, 1987 [FR] France ..... 87 13398

[51] Int. Cl.[5] ..... A63C 5/04
[52] U.S. Cl. ..... 280/610; 280/602
[58] Field of Search ..... 280/610, 609, 608, 602

[56] References Cited

U.S. PATENT DOCUMENTS

| | | | |
|---|---|---|---|
| 2,362,380 | 11/1944 | Kallstrom | 280/610 |
| 3,272,522 | 9/1966 | Kennedy | 280/11.13 |
| 3,537,717 | 11/1970 | Caldwell | 280/602 |
| 3,567,237 | 3/1971 | Miller | 280/610 |
| 3,762,734 | 10/1973 | Vogel | 280/610 |
| 3,879,245 | 4/1975 | Fetherston et al. | 156/245 |
| 3,995,984 | 12/1976 | Fetherston et al. | 425/521 |
| 4,260,576 | 4/1981 | Pollard | 264/257 |
| 4,405,149 | 9/1983 | Piegay | 280/602 |
| 4,537,417 | 8/1985 | Hirnbock et al. | 280/602 |
| 4,590,023 | 5/1986 | Hayashi et al. | 264/261 |
| 4,655,473 | 4/1987 | Muller et al. | 280/610 |
| 4,681,725 | 7/1987 | Maruyama | 264/46.5 |
| 4,795,184 | 1/1989 | Diard et al. | 280/609 |
| 4,838,572 | 6/1989 | Diard et al. | 280/609 |
| 4,911,462 | 3/1990 | Diard et al. | 280/607 |

FOREIGN PATENT DOCUMENTS

| | | | |
|---|---|---|---|
| 1223902 | 7/1987 | Canada . | |
| 1082534 | 11/1960 | Fed. Rep. of Germany . | |
| 2127330 | 12/1972 | Fed. Rep. of Germany . | |
| 3308599 | 9/1983 | Fed. Rep. of Germany . | |
| 3418568 | 2/1985 | Fed. Rep. of Germany . | |
| 71512 | 1/1960 | France . | |
| 1234047 | 10/1960 | France | 280/610 |
| 1355496 | 2/1964 | France . | |
| 2190484 | 2/1974 | France . | |
| 2553669 | 4/1985 | France . | |
| 3029672 | 2/1988 | Japan | 280/610 |
| 475835 | 9/1969 | Switzerland . | |

*Primary Examiner*—David M. Mitchell
*Attorney, Agent, or Firm*—Sandler, Greenblum & Bernstein

[57] ABSTRACT

A process for manufacturing a ski, and a ski manufactured by the process. The process according to the invention includes at least the following steps for manufacturing a ski whose body includes a core covered with a shell, wherein the shell is a composite sub-assembly: positioning the sub-assembly adjacent the cavity of a mold; positioning the core adjacent the shell; and exerting a force against the core to thereby force the shell within the mold cavity. In a preferred embodiment, the sub-assembly includes at least one layer of a filling material, preferably a thermoplastic material, which is caused to soften and flow under predetermined temperature and pressure conditions. In a modified embodiment, the mold cavity includes a depression or a projection on, for example, its lower surface which thereby produces a corresponding projection or depression, respectively, on the upper surface of the ski. By virtue of such a molding process, a variety of skis having various cross-sections and compositions are possible. For example, the upper edges of the skis thus manufactured can be reinforced with elements embedded in the filling material of which the edges can be made. Likewise, shock-absorbing material can be embedded within the aforementioned projections which can be made on the upper surface of the ski.

26 Claims, 12 Drawing Sheets

Fig- 1a
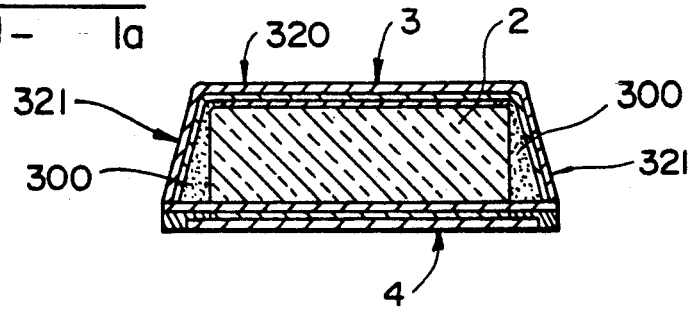
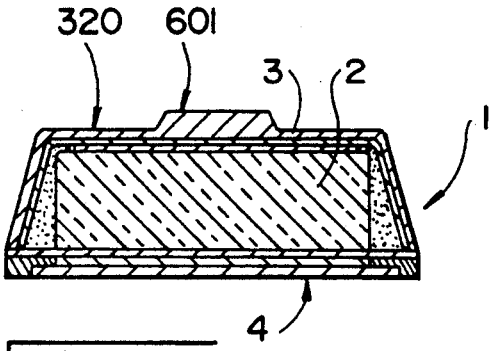
Fig- 1b
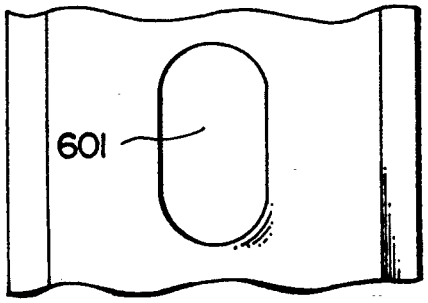
Fig- 1c
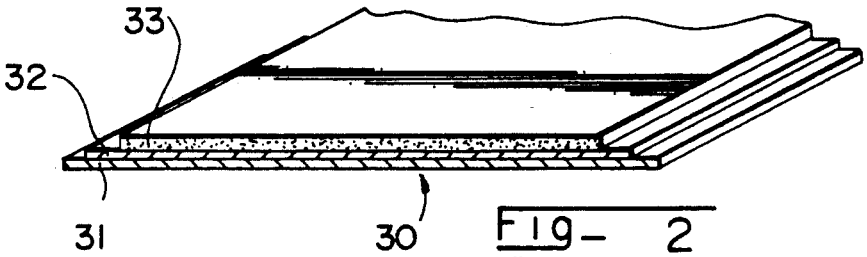
Fig- 2
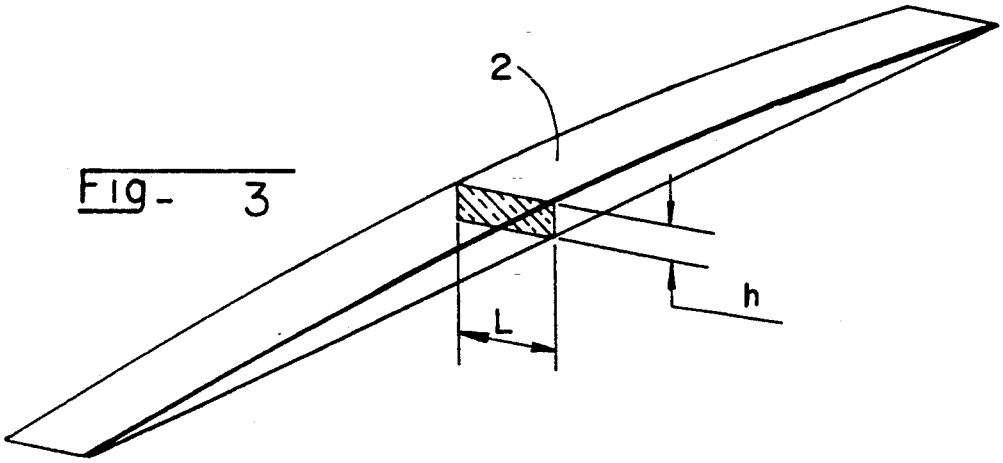
Fig- 3

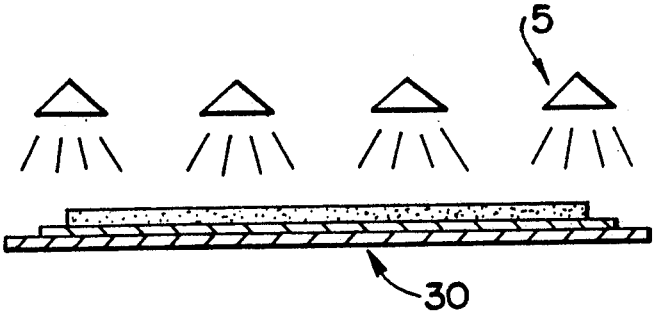
Fig- 4
Fig- 5a
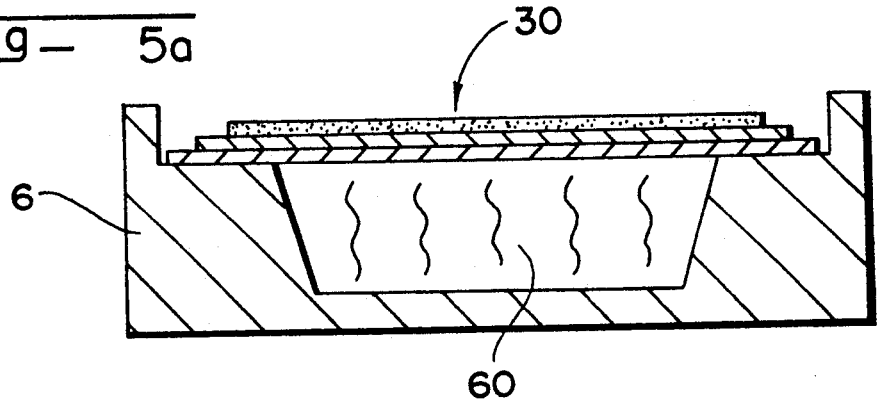
Fig- 6a
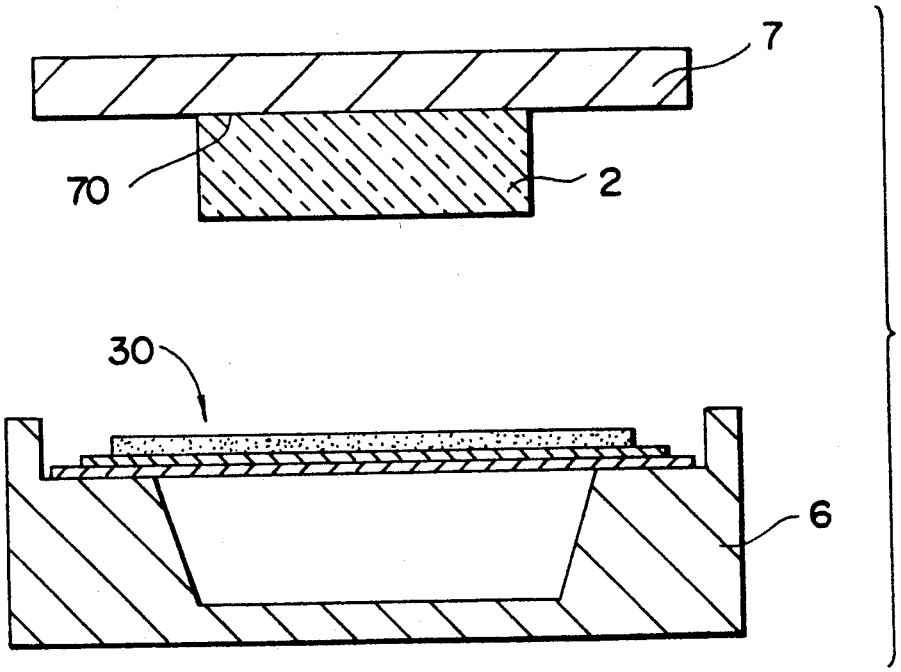

Fig- 14
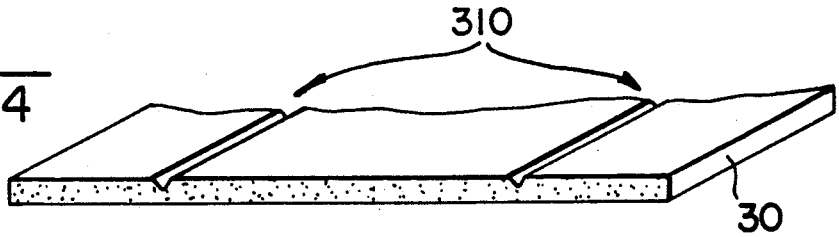
Fig- 15
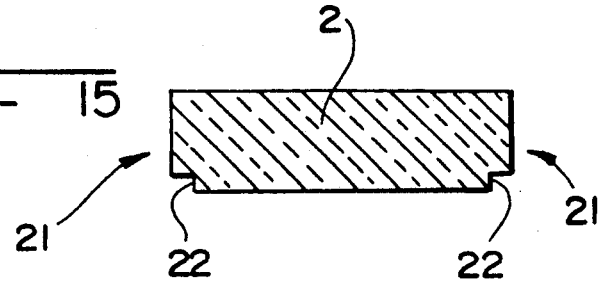
Fig- 16
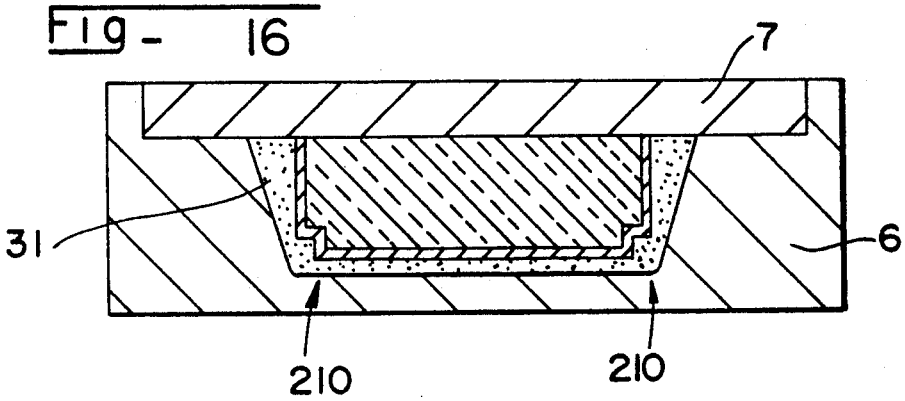
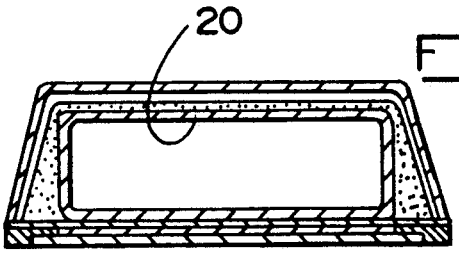
Fig- 17
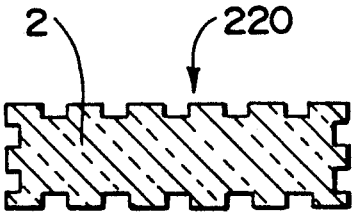
Fig- 18

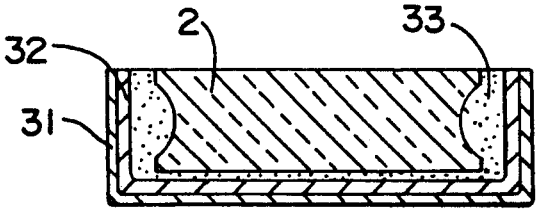
Fig- 22
Fig- 23
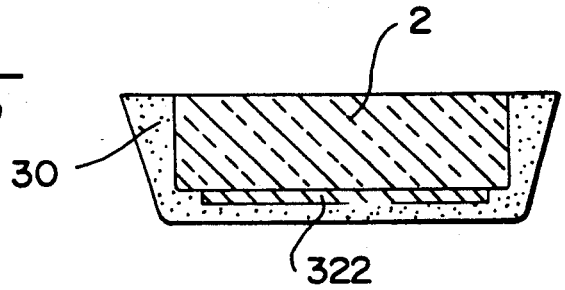
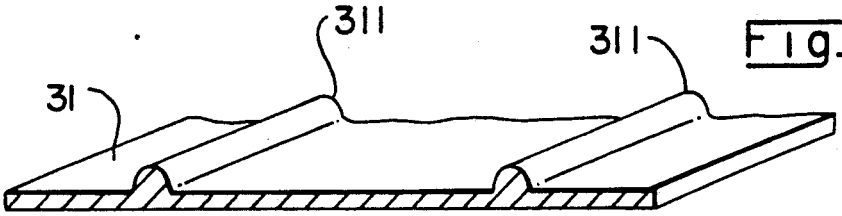
Fig- 24
Fig- 25
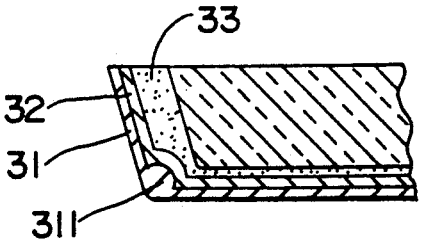
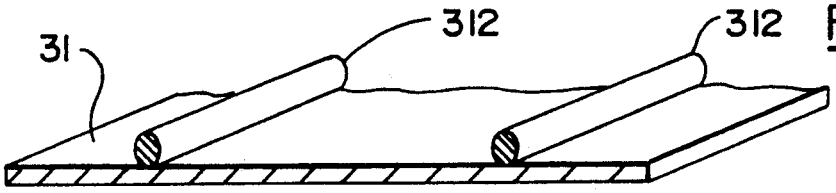
Fig- 26
Fig- 27
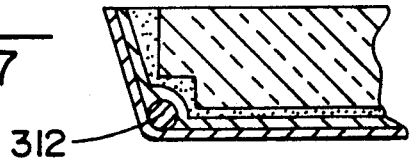

PROCESS FOR MANUFACTURING A SKI, AND A SKI MANUFACTURED BY THE PROCESS

CROSS-REFERENCE TO RELATED APPLICATIONS

This application is a division of application Ser. No. 07/158,925, filed on Feb. 22, 188, now U.S. Pat. No. 5,183,618.

BACKGROUND OF THE INVENTION

1. Field of the Invention

The present invention relates to a process for manufacturing a ski and a ski manufactured according to the process.

2. Description of Background and Relavant Information

Skis have traditionally been manufactured from wood. However the modern market has greatly evolved and a variety of new materials are now used. Thus, a ski manufacturing industry has been created which employs modernized equipment and utilizes the new materials which are now available to it, such as composite materials, which include, for example, aluminum and synthetic foam.

In so doing, however, ski manufactures have been making effective use of the new materials, but they have not adapted their methods of manufacturing accordingly. Consequently, traditional methods of manufacture remain very costly.

SUMMARY OF THE INVENTION

It is, accordingly, an object of the present invention to provide a process of manufacturing a ski whose body comprises a core covered with a shell, and wherein the shell comprises a composite sub-assembly. The process according to the invention includes at least the following steps: positioning the sub-assembly adjacent a mold cavity of a mold; positioning the core adjacent the shell; and exerting a force against the core to force the shell within the mold cavity.

The sub-assembly includes a filling material, which is preferably a thermoplastic material which is adapted to flow into empty spaces within the mold cavity to permit the ski to substantially assume the shape of the mold cavity.

Prior to the step of positioning the sub-assembly adjacent a mold cavity, the sub-assembly and core are appropriately prepared.

The sub-assembly is preferably pre-heated prior to being forced into the mold.

The step of pre-heating can be performed by positioning the sub-assembly upon the mold, while the core is attached to a cover of the mold, and heating the mold.

Alternatively, the step of pre-heating can be performed by positioning the sub-assembly upon the mold, with the core positioned upon the sub-assembly, and heating the mold.

According to another aspect of the invention, the step of preparing the sub-assembly further includes positioning a reinforcement layer between two layers of thermoplastic material, wherein at least one of the two layers of thermoplastic material constitutes the filling material.

The thermoplastic filling material can be, for example, acrylonitrile butadiene styrene, polyamide, polycarbonate, or an ethylene vinyl acetate ionomer. The core can be made of a synthetic foam.

According to a further aspect of the invention, the core can be constituted by a beam having a substantially rectangular cross-section throughout its length, the rectangular cross-section having a substantially constant width throughout its length, and a decreasing height in the direction of each end.

The reinforcement layer of the sub-assembly can be made of glass, carbon, or other material, impregnated with a thermoplastic resin such as a polyetherimide or a thermosetting resin such as an epoxide or polyurethane.

According to a still further aspect of the invention, the core and sub-assembly are removed from the mold and a sliding element is attached to constitute the lower surface of the ski.

According to a still further aspect of the invention, the sub-assembly and the core can be made from a composite material.

The sub-assembly can be provided with at least one outer layer of a thermoplastic material and at least one layer within the outer layer made of aluminum or a laminated material.

According to an alternative embodiment, the ski can include an outer layer made of a filling material, preferably a thermoplastic material.

The ski, according to the invention, can be made to have a substantially trapezoidal transverse cross-section.

The core of the ski can be made to have a substantially rectangular transverse cross-section, or any other shape, and can be made of synthetic foam.

According to an alternative embodiment, the mold cavity further includes a depression in a least one surface, into which the thermoplastic material is adapted to flow to thereby create a ski having a projection on its upper surface.

According to a further embodiment, the mold cavity further includes a projection on at least one surface, which is adapted to project within the thermoplastic material to thereby create a ski having a depression in its upper surface.

The sub-assembly can be modified to include longitudinally extending grooves on one side of the sub-assembly to enhance its bending.

According to a further embodiment, an additional element having a width less than that of the depression can be positioned adjacent the filling material to thereby become embedded with the projection on the upper surface of the ski.

To ensure the proper flowing of the filling material, the mold further includes a space into which excess filling material is adapted to flow.

To ensure the polymerization of materials, the mold is preferably heated to approximately 120–160 degrees centigrade.

According to another aspect of the invention, the step of preparing the sub-assembly can further include providing a carrier including a decoration of sublimable ink, the ink being placed in contact with the sub-assembly to thereby penetrate into the surface of the ski during molding.

According to a still further aspect of the invention, the step of exerting a force against the core includes exerting a force against the cover of the mold which is placed adjacent the core, thereby closing the mold.

It is a further object of the invention to manufacture a ski according to the process set forth above in which the ski includes a core; a shell, including at least one filling material layer; and a lower element; wherein the at least one filling material layer has a thickness which is non-uniform.

The ski according to the present invention can include a core which has a transverse cross-section which is non-rectangular.

According to one embodiment, the ski can include a shell which includes an outer surface made of filling material.

The ski according to a further embodiment can include upper edges made of filling material having a thickness greater than other portions of the filling material layer.

According to a further aspect of the invention, the ski can include an upper plate adjacent the upper surface of the core.

According to a still further aspect of the invention, the shell of the ski can include an outer layer which includes longitudinally extending reinforcement elements, which can be integral with the outer layer, located along the upper edges of the ski.

According to a still further aspect of the invention, the outer layer constitutes an appearance layer; the intermediate layer constitutes a reinforcement layer; and the inner layer constitutes a layer of filling material.

The outer layer according to one aspect of the invention can be made from one of the group consisting of acrylonitrile butadiene styrene, polyamide, and polycarbonate.

The intermediate layer according to another aspect of the invention can include one or more sheets selected from the group consisting of glass, carbon, and KEVLAR. The intermediate layer can be impregnated with a thermoplastic resin. Additionally or alternatively, the intermediate layer can comprise a unidirectional fabric having at least 90 percent warp fibers. Further, the intermediate layer can comprise an additional fabric having oblique fibers.

According to a still further aspect of the invention, the outer layer as well as the inner layer can be made of thermoplastic material. In such a case, the inner layer is adapted to soften and flow at a temperature lower than that of the outer layer.

According to a still further aspect of the invention, particularly if the core is non-porous, the core can include grooves or holes adapted to enhance the connection between the core and the shell.

According to a still further aspect of the invention, the core can be made from a hollow tubular element.

According to a still further aspect of the invention, the ski can include a projection on its upper surface which includes an additional element embedded therein, the additional element made of a material selected from the group consisting of a thermplastic material, metal, glass fibers, carbon, and KEVLAR. Alternatively, the additional element can be made of a shock absorbent material.

BRIEF DESCRIPTION OF THE DRAWINGS

FIG. 1*a* illustrates, in transverse cross-section, a ski manufactured according to the present invention;

FIG. 1*b* illustrates, in transverse cross-section, a modified ski according to the present invention;

FIG. 1*c* illustrates, in plan view, the modified ski of FIG. 1*b;*

FIG. 2 illustrates, in perspective view, a preferred embodiment of a sub-assembly which makes up the outer shell of the ski of the present invention;

FIG. 3 illustrates, in perspective view, the core of the ski of the present invention;

FIG. 4 illustrates the step of preheating the sub-assembly before the molding process;

FIGS. 5*a* and 5*b* illustrate an alternative form of preheating the sub-assembly;

FIGS. 6*a* and 6*b* illustrate the relative positions of the core and the sub-assembly with reference to the mold and mold cover prior to the molding step;

FIG. 14 illustrates, in perspective view, a further variation of the sub-assembly which includes longitudinal grooves;

FIG. 15 illustrates, in transverse cross-section, a variation of the core;

FIG. 16 illustrates the full closure position of the mold wherein the core of FIG. 15 is utilized;

FIG. 17 illustrates, in transverse cross-section, a further embodiment of the ski, wherein the core is made from hollow tubular material;

FIG. 18 illustrates, in transverse cross-section, a variation of the core, necessary when made from a non-porous material;

FIG. 22 illustrates, in transverse cross-section, an alternative embodiment of the ski body, whereby the core is non-rectangular;

FIG. 23 illustrates, in transverse cross-section a further embodiment of the ski, wherein a reinforcement layer is not utilized;

FIG. 24 illustrates an alternative embodiment of the outer layer of the sub-assembly including reinforcement elements;

FIG. 25 illustrates, in partial transverse cross-section, a ski body made utilizing the outer layer of FIG. 24;

FIG. 26 illustrates, in perspective view, an alternative embodiment of the outer layer of the sub-assembly including another form of reinforcement element; and FIG. 27 illustrates, in partial transverse cross-section, a ski body made utilizing the outer layer of FIG. 26.

DESCRIPTION OF PREFERRED EMBODIMENTS

Figure 5B:
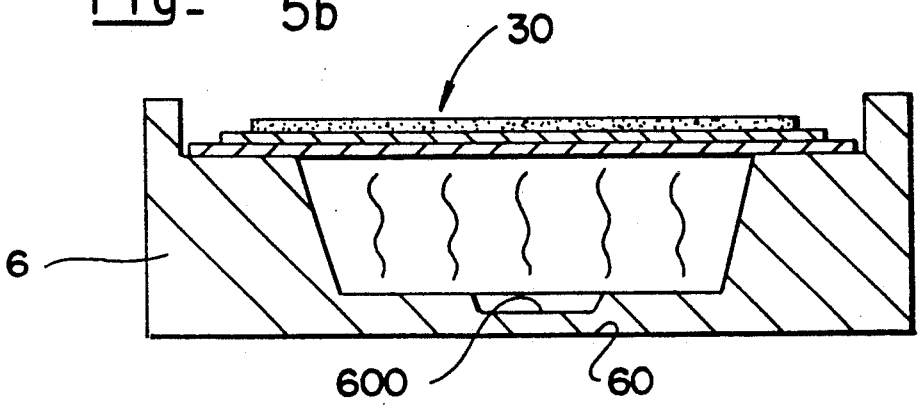

The present invention attempts to resolve the disadvantages of the traditional and relatively costly ski manufacturing processes. To this end, the present invention includes a new process of manufacture which is especially adapted to the modern materials now available. The process according to the invention, however, is particularly simple and relatively inexpensive.

The invention additionally includes the skis which are manufactured according to the aforementioned process. Skis made according to the process include a core which is covered by a shell or casing. The shell or casing is preferably composed of a composite assembly. The sub-assembly includes a filling material, such as a thermoplastic material, which is adapted to flow during a molding process.

The process includes at least the following steps:

a) preparing the sub-assembly;
b) preparing the core; and
c) deforming the sub-assembly with the aid of the core and enabling the filling material of the sub-assembly to flow within the mold cavity to thereby assume the shape of the mold cavity.

The flowing or deformation of the filling material of the shell or casing occurs at a temperature sufficient to soften the thermoplastic material which thereby enables the flowing or deformation.

By the process of the present invention, by suitably shaping the surfaces of the cavity of the mold, one can, for example, create cavities or projections on or in the surface of the ski. Such depressions or projections on the ski can be used, for example, to mate with complementary surfaces on the sole of a ski boot to be used in association with a ski. One such use, for example, would be the integral formation of a longitudinal lateral retention rib on the upper surface of the ski for mating with a complementary groove of a cross-country ski boot. Other such uses could include, for example, more localized projections or depressions for mating with portions of a ski binding to be used with the ski.

FIGS. 1*a* and 1*b* illustrate, in transverse cross-section, a ski 1 which has been manufactured according to the invention. The ski includes the following three principal portions: a core 2, a shell 3 and a lower element 4. Core 2 may be made from one of a number of different materials, such as, for example, synthetic foam, wood, aluminum honeycomb, or from metallic or plastic tube 20, which is shown in FIG. 17. Likewise, the core can be made out of a combination of any of the foregoing materials.

FIGS. 1*a* and 1*b* show a ski made according to the process of the present invention which includes on its upper surface a projection 601. This projection can extend substantially the entire length of the ski or it may simply constitute a somewhat localized projection as is shown in the plan view of FIG. 1*c*.

The process according to the present invention will be described with particular reference to FIGS. 2–11*b*, and with occasional reference to other figures.

The sub-assembly 30 is initially prepared. This sub-assembly can include, by way of an example, three layers 31, 32, and 33, having a predetermined length, width, and thickness. The sub-assembly 30, as will be seen below, is adapted to constitute the aforementioned shell or casing 3 of the ski.

The first layer 31 is made from a thermoplastic material such as acrylonitrile butadiene styrene, generally known as ABS, or polyamide (PA), or polycarbonate (PC). Additionally, layer 31 can be made from one or more sheets.

In addition to the first layer 31, the ski according to the process of the invention can include one or more intermediate layers 32, each of which can be made of one or more sheets of glass fibers, carbon, KEVLAR (a registered trademark for aromatic polyamide compounds) fabric, or other materials. These intermediate layers 32 are, preferably, impregnated with thermoplastic resins such as polyetherimides, polyether sulfone, polyamide, or thermo-setting resins such as epoxides or polyurethanes. The fabric made of glass or the like is preferably of the uni-directional type and includes, for example, 90% warp fibers and 10% woof fibers. One or more of the layers can be made to include oblique fibers.

In addition to layers 31 and 32, the ski according to the invention, preferably includes a third layer 33 which is made of one or more sheets of thermoplastic material. Layer 33 can be made from the same material as the first layer 31, or from a different material, for example, having a characteristic that permits it to soften and flow at a lower temperature than the material of the first layer.

Figure 12:
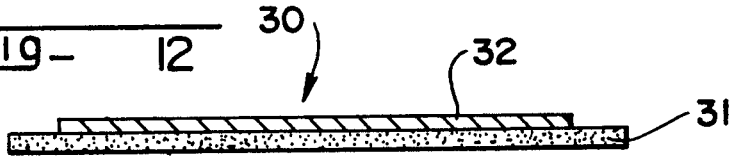
FIG. 12 illustrates a variation of the sub-assembly in which filling material is used as the outer ski layer.
Figure 13:
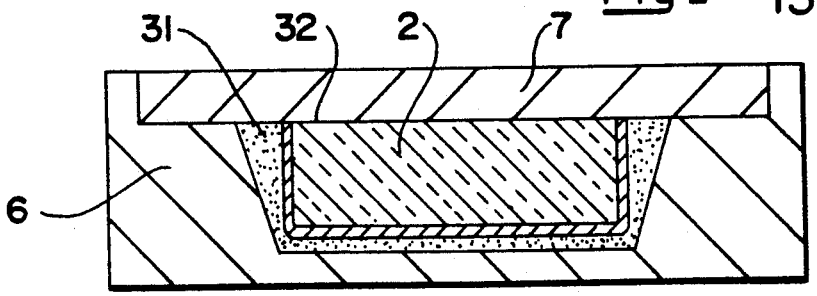
FIG. 13 illustrates the full closure position of the mold wherein the sub-assembly of FIG. 12 is utilized.

As will be seen below, the third layer 33 constitutes the filling material, while the intermediate layer 32 constitutes the reinforcement of the shell, and the first or inner layer 31 constitutes an outer appearance layer. However, it is not beyond the scope of the invention for layer 31 to constitute both the appearance layer and the filling layer, as is shown in FIGS. 12 and 13.

In addition to preparing the shell or casing 3 in the manner set forth above, the process according to the invention includes the preparation of the core 2. The core 2 can be, for example, made from wood, or synthetic foam which can be reinforced by glass fibers.

FIG. 3 illustrates a perspective view of the core 2 and illustrates, as as an example, a substantially rectangular transverse cross-section having a substantially constant width L and a height h. The height h decreases toward either end. The dimensions are determined as a function of the material used for the core and the sub-assembly, including the filling material.

Once the sub-assembly 30 of the shell or casing 3 is prepared, and prior to the molding operation itself, the sub-assembly 30 is, preferably, preheated at a predetermined temperature.

This preheating step permits the sub-assembly to be softened to the extent that it can be more readily deformed during molding. This preheating step can be accomplished in a number of ways. For example, the sub-assembly 30 can be heated by infrared lamps 5, separate from the mold, such as is shown in FIG. 4. On the other hand, after the mold 6 has been adequately preheated, the sub-assembly 30 can be placed on the mold, as is shown in FIGS. 5*a* and 5*b*. This permits the heat 60 of mold 6 to be transmitted to the sub-assembly to thereby preheat the sub-assembly by conduction or radiation.

Figure 7A:
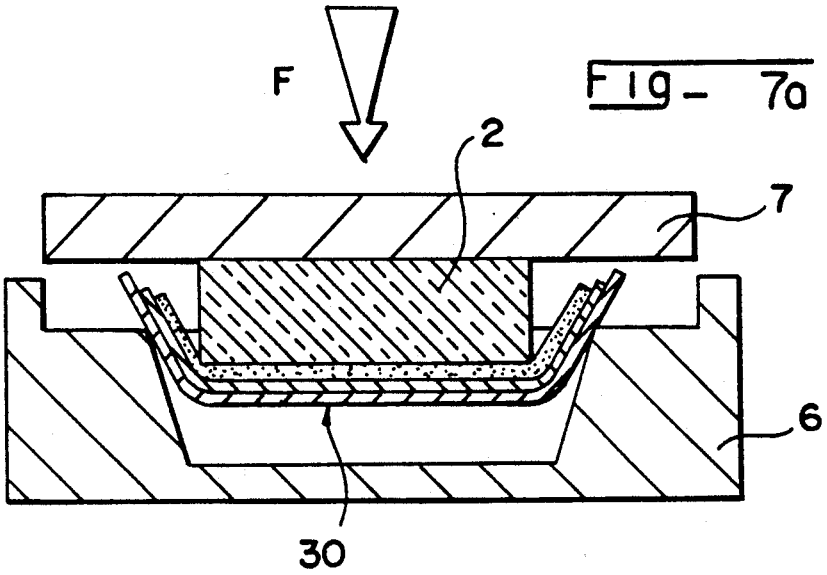
FIGS. 7*a* and 7*b* illustrate the forcing of the sub-assembly into the mold cavity with the aid of the core.
Figure 8A:
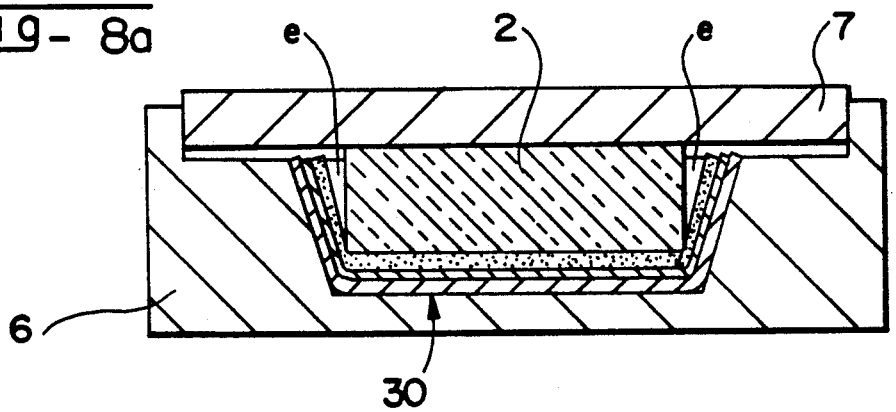
FIGS. 8*a* and 8*b* illustrate an intermediate closure position of the mold in which the filling material of the subassembly is not yet compressed and the mold cover is not completely seated.
Figure 9A:
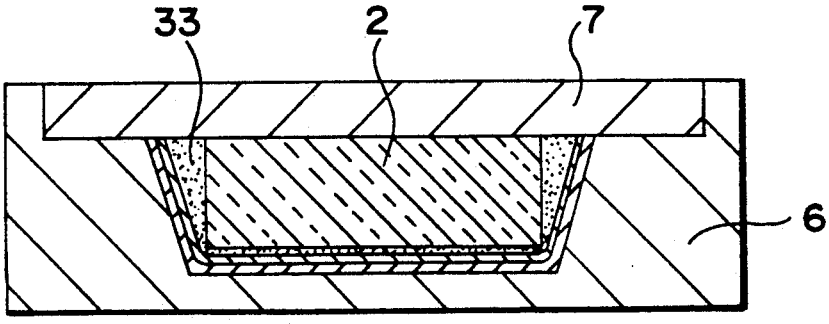
FIGS. 9*a* and 9*b* illustrate the full closure position of the mold in which the filling material is compressed and has flowed into the free spaces of the mold cavity.
Figure 7B:
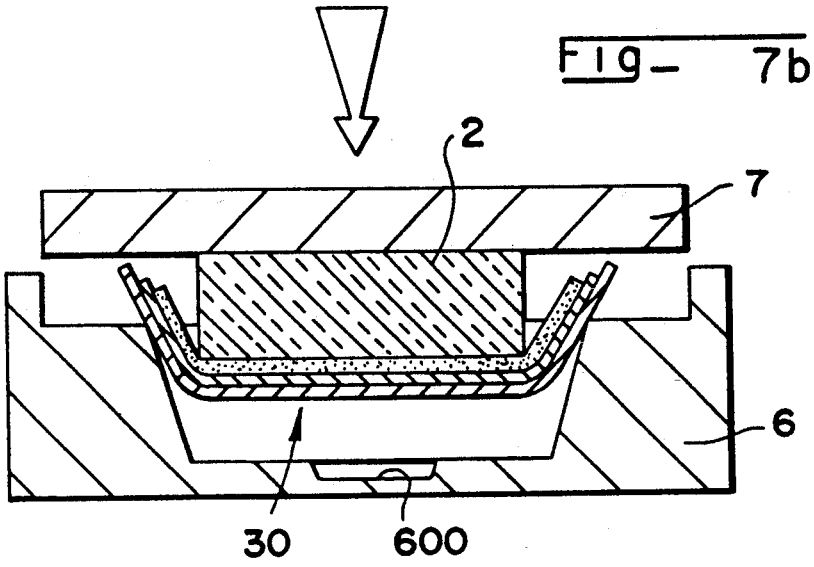
Figure 8B:
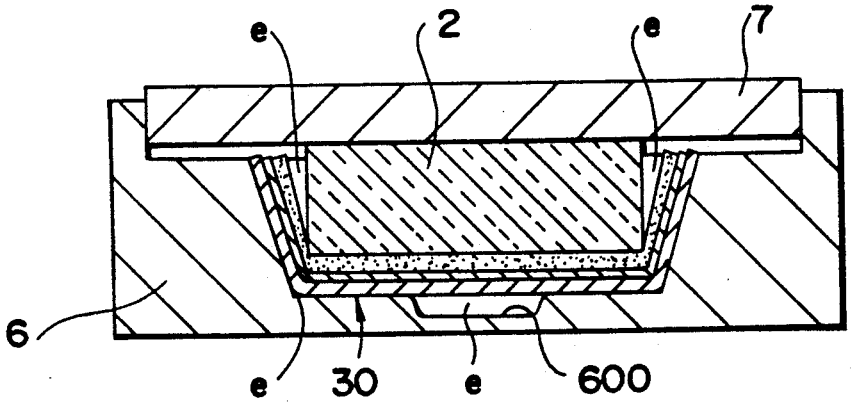
Figure 9B:
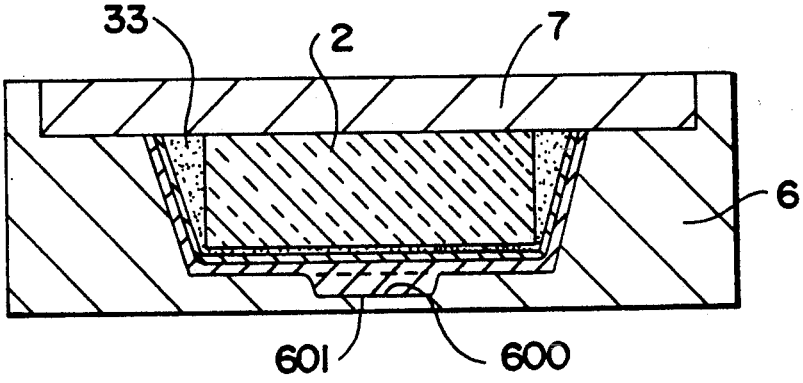

After the mold 6 has been heated to approximately 120°-160° C. and the sub-assembly is positioned on the mold as is shown in FIGS. 5*a*, 5*b*, 6*a*, and 6*b*, the sub-assembly is forced into the mold cavity, as is shown in FIGS. 7*a*, 7*b*, 8*a*, and 8*b*, until the mold is completely closed, as is shown in FIGS. 9*a* and 9*b*. Once the mold 6 is completely closed, the ski body formed by the core 2 and sub-assembly 30 is maintained in the mold for a sufficient amount of time to allow for the polymerization of the different materials.

Figure 6B:
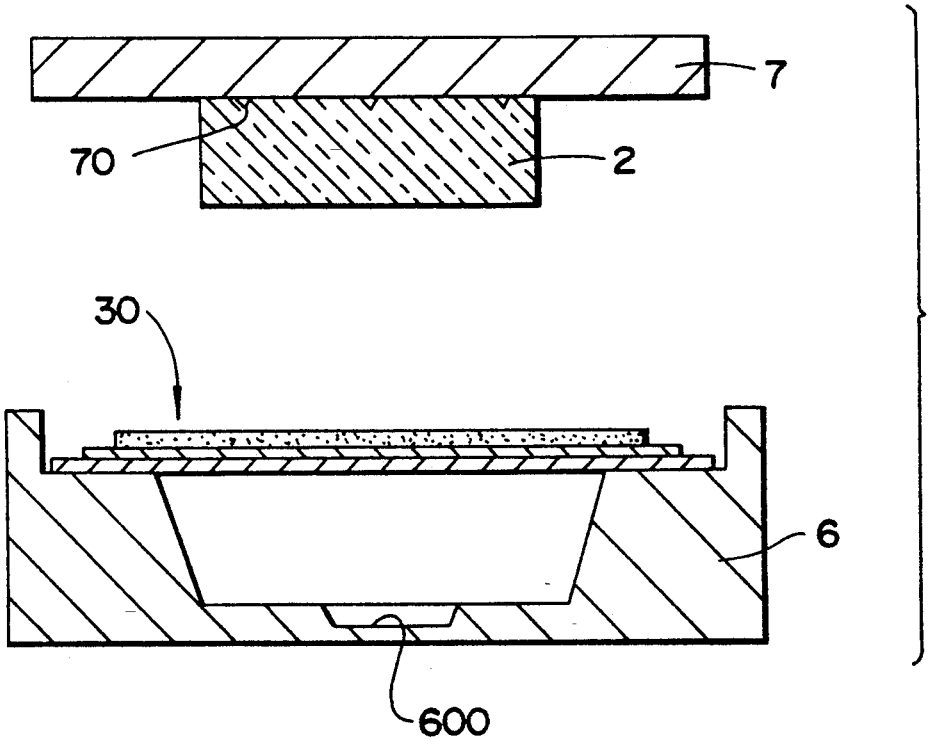
Figure 21:
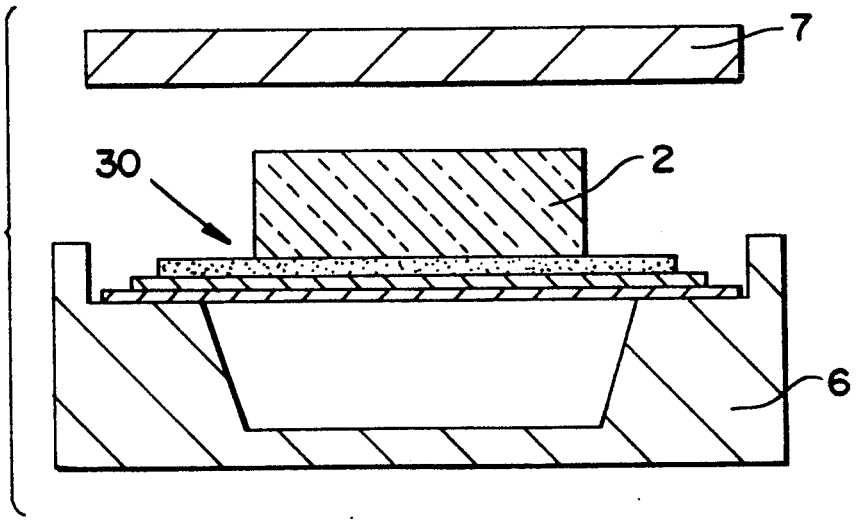
FIG. 21 illustrates an alternative embodiment showing the relative positions of the core, sub-assembly, and mold prior to the molding step.

Prior to the sub-assembly being forced into the mold cavity, the core 2 is preferably attached to the lower surface of cover 7 of mold 6, as is shown in FIGS. 6*a* and 6*b*. The core 2 can be attached to the cover 7 by being glued thereto or, alternatively, it can be attached by points 70. Alternatively, the core 2 could be merely positioned upon sub-assembly 30 prior to the closing of the mold, as is shown in FIG. 21. The core can be maintained on the sub-assembly in the position shown in FIG. 21, if desired, by gluing it thereto.

FIGS. 7*a* and 7*b* illustrate an intermediate closure position of the mold 6. In this position, the various layers of the sub-assembly 30 and, in particular, layer 33, which contain filling material, are not compressed. From the position shown in FIGS. 8*a* and 8*b* to the position shown in FIGS. 9*a* and 9*b*, the filling material begins to flow into the free spaces e. It is seen, therefore, that the flow results from both the elevated temperature, which softens the thermoplastic filling material, and the compression of the filling material by the core 2 by means of the force exerted during closure of the mold.

The process according to the invention, and in particular the last mentioned phase, is particularly well-adapted to producing a ski which has a transverse cross-section which is other than rectangular. In addition, the process according to the invention is well-adapted to a ski whose core's transverse cross-section is other than rectangular. Note the transverse cross-section of the ski illustrated in FIG. 22, for example. The process according to the present invention can, therefore, be particularly advantageous for manufacturing skis having inclined sides, i.e., having a substantially transverse cross-section, such as disclosed in French Applications 86.07849, 86.07850, 86.07851, and 86.07852.

To manufacture a ski, for example, as shown in FIGS. 1*b* and 1*c*, or one having a depression rather than a projection on at least one surface of the ski, a corresponding surface of the mold cavity can be suitably shaped. In this regard, reference is made to FIGS. 7*b*, 8*b* and 9*b*, which correspond to FIGS. 7, 8 and 9, respectively. In these figures, a depression 600 is shown in the lower surface of the mold cavity to thereby produce a projection 601 on what will be the upper surface of the completed ski. As mentioned above, during the flowing of the thermoplastic material, the depression within the mold cavity will be filled in the same manner as any other free space e is filled by the thermoplastic material.

Figure 11B:
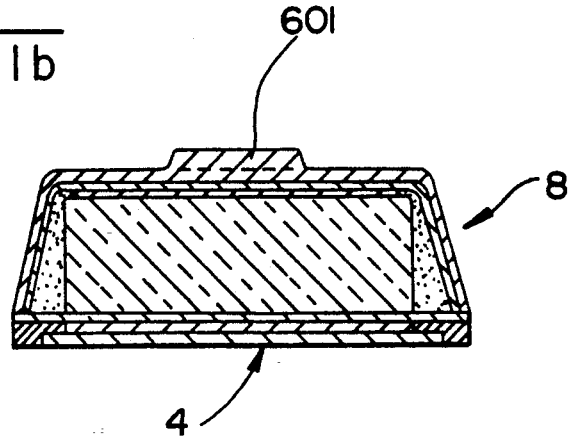
Figure 11C:
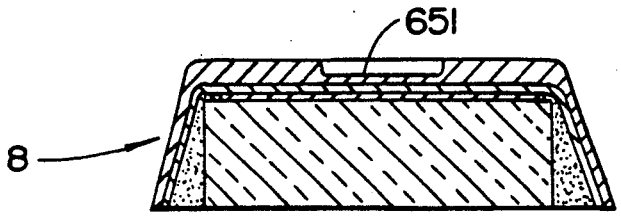
FIG. 11*c* illustrates, in transverse cross-section, a ski body made with a depression in its upper surface.
Figure 11D:
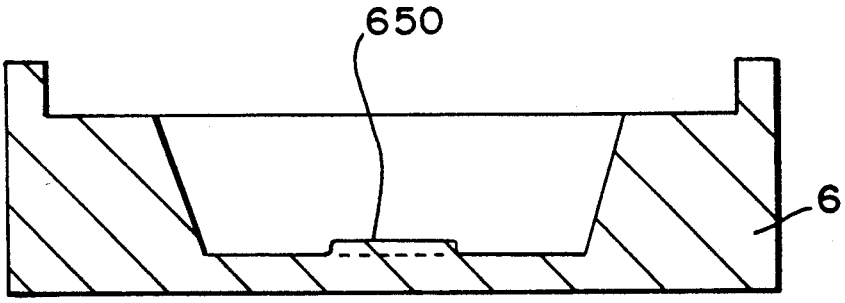
FIG. 11*d* illustrates, in transverse cross-section, a modified mold to produce the ski body of FIG. 11*c;*

Alternatively, and as mentioned above, the upper surface of the ski according to the present invention, can include a depression such as 651, as is illustrated in FIG. 11*c*. For manufacturing such a ski, the interior of the mold would include a complementary projection 650, as is illustrated in FIG. 11*d*.

Figure 11E:
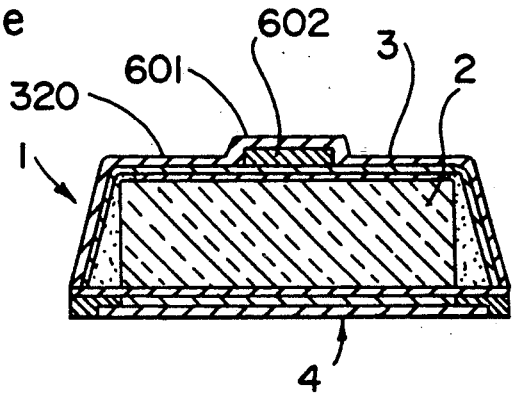
FIG. 11*e* illustrates, in transverse cross-section, a ski according to the invention having a projection on its upper surface with an additional element embedded therein.

According to the process of the present invention, projection 601 can include an additional element 602, as is illustrated in FIG. 11*e*. This additional element can be embedded and thereby be made to be internal of projection 601 and, additionally, can be made from a thermoplastic material. Alternatively, element 602 can be metallic or laminated glass fibers, or can be made from carbon or KEVLAR (a registered trademark). Element 602 can be made to correspond to the shape of projection 601 or can have any other shape. Preferably, element 602 is to made of a shock absorbent material, for example, a visco-elastic material.

Figure 11F:
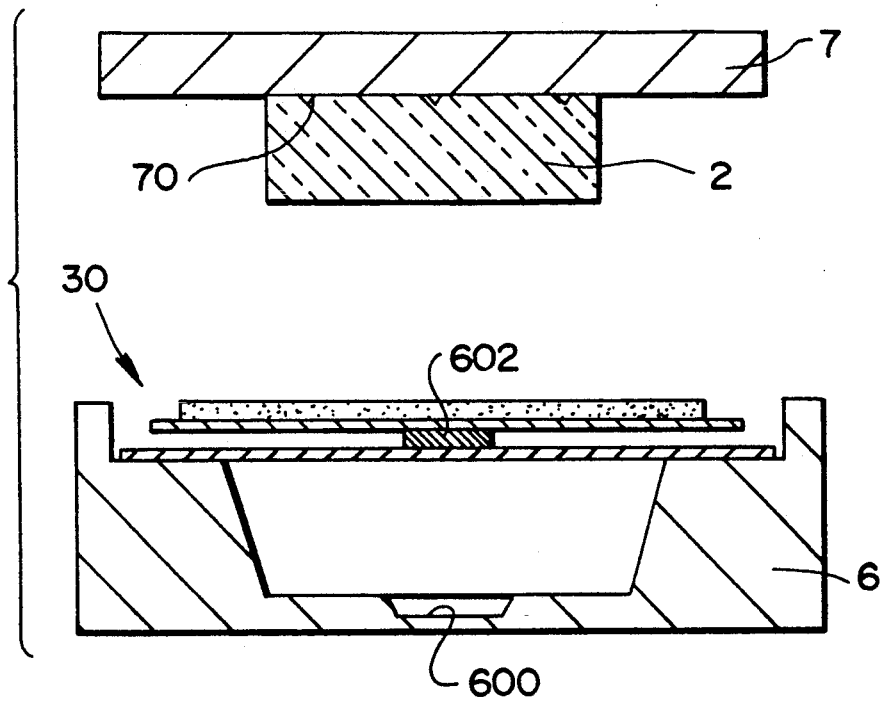
FIG. 11*f* illustrates, in transverse cross-section, a view analogous to that of FIG. 6 prior to the manufacture of the ski of FIG. 11*e;*

FIG. 11*e* illustrates the positioning of element 602 prior to the molding step, as for example, during the preheating step in which the sub-assembly 30 is positioned on top of mold 6. In FIG. 11*f*, it can be seen that element 602 is positioned within the layers of the sub-assembly 30, preferably between the outer layer and the intermediate layer, wherein the intermediate layer is immediately adjacent the layer of filling material.

Figure 10A:
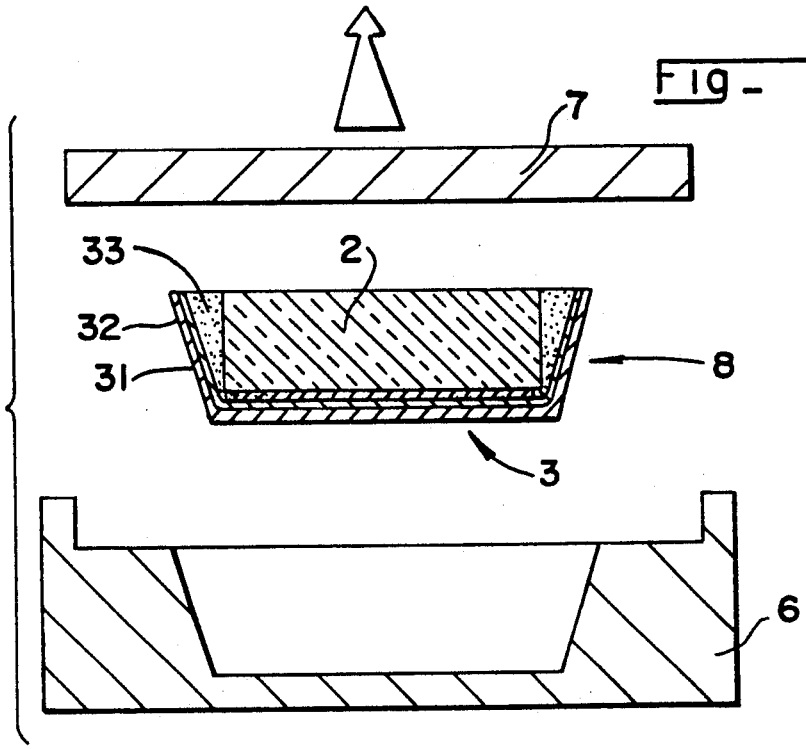
FIGS. 10*a* and 10*b* illustrate the opening of the mold after the ski body has been made.
Figure 11A:
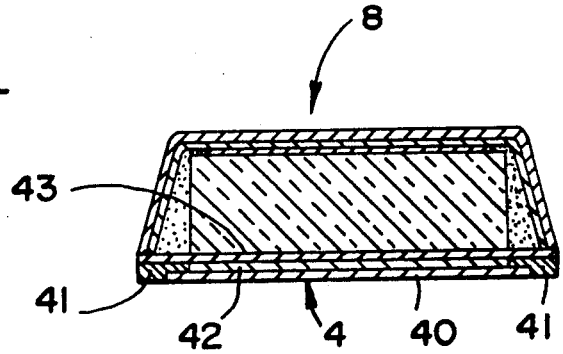
FIGS. 11*a* and 11*b* illustrate, in transverse cross-section, the ski made according to the present invention in which the lower surface element of the ski has been attached to the ski body.
Figure 10B:
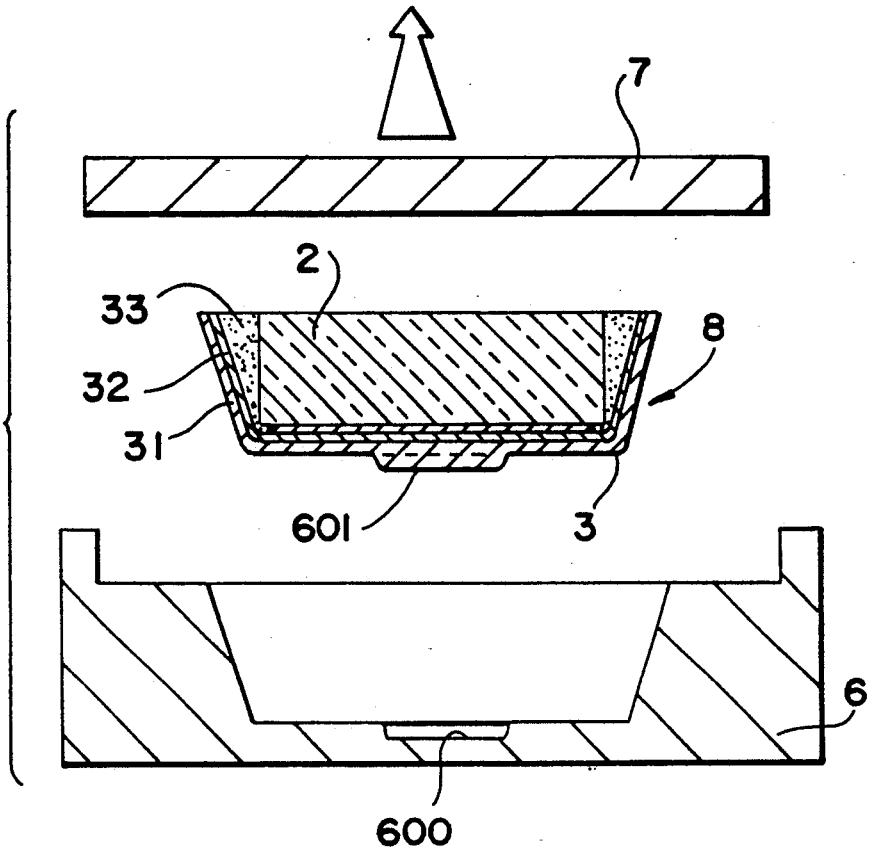

After the assembly of the core 2 and sub-assembly 30 have been positioned within the mold for the predetermined amount of time to allow for the polymerization of the different materials, as mentioned above, the mold is opened and the body of the ski which, at that time, includes core 2 in casing 3, is cooled. Reference is made to FIGS. 10 and 10*a*, which show the body of the ski 8 after the mold has been opened and in which the ski body 8 has assumed the desired shape.

Once the ski body 8 has been made according to the aforementioned steps, the lower element 4, which will provide the lower sliding surface for the ski, is attached. The lower element 4 can be made, for example, out of polyethylene, while the lateral edges 41 can be made, for example, out of steel. Lower element 4 is preferably made to have a number of layers. Such layers can include layer 42 which is made, for example, from glass fibers, and a layer 43 which is made, for example, out of aluminum or a laminated material.

The following description will include variations to the materials and elements used from the foregoing, however, the process of manufacturing the ski using the alternative materials and elements is substantially the same as that already described.

Sub-assembly 30 can be made to have two or more layers, as is depicted, for example in FIGS. 12 and 13, wherein layer 31 includes a sheet of thermoplastic material and layer 32 includes one or more sheets of a glass fabric or a material impregnated with a thermosetting or thermoplastic resin. In this example, layer 31 will provide the filling layer, which will flow under the predetermined temperature and pressure conditions as set forth above, to thereby permit the ski body to assume the shape of the mold cavity. In this example, the outer layer 31 will constitute both the outer appearance layer as well as providing the function of the filling layer.

As illustrated in FIG. 14, the sub-assembly 30 can include longitudinal grooves 310 to facilitate its folding as it is, for example, forced within the mold 6.

In another alternative, the core 2 can be prepared to have upper corners 21 comprising longitudinal notches 22, as illustrated in FIG. 15, so that, in the example whereby the filling material constitutes the outer layer, reinforced corners 210 are provided, as is shown in FIG. 16.

According to the process of the present invention, and with reference to FIG. 1*a*, despite the core 2 having rectangular cross-section, the filling material of layer 31 and/or 33 will ensure, by virtue of the flowing of the filling material under predetermined pressure and temperature conditions, the filling of the mold cavity to thereby produce a ski having substantially trapezoidal cross-section, whereby the lateral triangular zones 300 are filled. To produce a ski according to the process of the present invention, the thickness of the filling layers must be such that the quantity of material necessary for producing the filling is ensured to thereby create, in the thermoplastic layer, a layer having a substantially uniform density without having irregularities that would affect the quality of the ski thereby produced.

The mechanical connection which is effected between core 2 and sub-assembly 30 of shell 3 is ensured by the flowing of the thermoplastic material into the pores of the core 2. In the case of skis manufactured according to the process of the present invention in which the core is a non-porous material, or one in which the core is not adequately porous, grooves or holes 220 can be provided in core 2, as is illustrated in FIG. 18, to thereby enhance the mechanical connection between the core and the sub-assembly of the casing.

Figure 19:
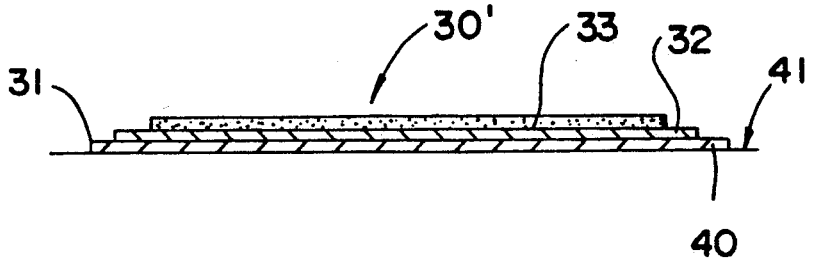
FIG. 19 illustrates a further variation of the sub-assembly, wherein the outer surface of the ski is to be decorated.

According to the process of the present invention, the decoration of the upper surface of the ski 320, as well as the decoration of the lateral edges 321, if desired, can be done at the same time as the ski body 8 is created by sublimation. To this end, the sub-assembly 30', as is illustrated in FIG. 19, is adequately prepared. In this regard, layer 31 is preferably made from suitable materials for sublimation such as, for example, RILSAN (a registered trademark) or P BAX (a registered trademark). A carrier 40, preferably made of paper, is included adjacent layer 31, with carrier 40 including the desired decoration 41 made from sublimable ink. Of course, carrier 40 is positioned such that the ink 41 is positioned in contact with layer 31. With the sub-assembly 30' thus created, the process according to the present invention is performed beginning with the preheating step as illustrated in FIG. 4 and the subsequent steps discussed above.

During the heating of the ski body 8 within the mold 6, as begins in the step illustrated in FIGS. 8*a* and 8*b*, the sublimable ink, by thermal effect, will penetrate into the material of the sub-assembly, that is, into layer 31, and the ski will thereby be suitably decorated.

Figure 20:
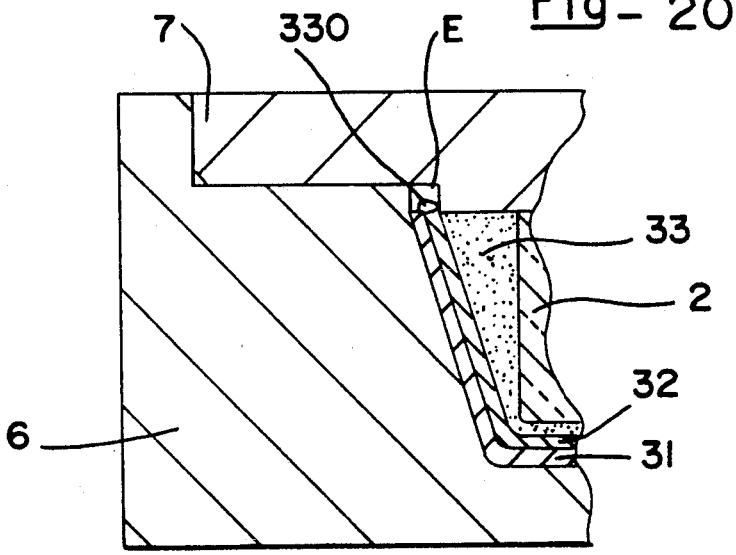
FIG. 20 illustrates in partial transverse cross-section, an alternative embodiment of the mold and the mold cover.

FIG. 20 illustrates a preferred embodiment according to the present invention, whereby the mold cavity includes a space E into which the thermoplastic material flows during the molding process to thereby ensure that an adequate quantity of material is used to form the body of the ski, and whereby surplus material flows. A rough edge 330 is thereby formed after the molding step, which rough edge 330 can be easily removed.

FIG. 23 illustrates an alternative embodiment of the body of the ski in transverse cross-section. According to this embodiment, the body of the ski does not include a reinforcement layer as in the preceding embodiments. However, an upper plate 322 is utilized which is made of a layer of prepolymerized resin and glass fibers (or a hybrid thereof), or of a thermosetting or thermoplastic resin, or of a metal alloy.

In this embodiment, the reinforcement of the upper edges of the ski can be made as was discussed with regard to FIGS. 15 and 16 or, alternatively, alternative formations can be used.

To this end, as is illustrated in perspective view in FIG. 24, the outer layer 31 of the ski can include two longitudinally extending projections 311. FIG. 25 illustrates, in partial transverse cross-section, the position of longitudinally extending elements 311 in the completed ski body.

Alternatively, outer layer 31 can have attached thereto longitudinally extending supplemental elements 312 as shown in FIG. 26. FIG. 27 illustrates, in partial transverse cross-section, the longitudinally extending reinforcement elements 312 in the completed ski body. Element 312 can be made of steel wire or of any other suitable material to provide reinforcement for the upper edge of the ski.

Although the invention has been described with reference to particular materials and embodiments, and with regard to particular means for manufacturing skis, it is to be understood that the invention is not limited to the particulars disclosed, but extends to all equivalents within the scope of the claims.

We claim:

1. A ski comprising:

(a) a core;

(b) a shell comprising at least two layers comprising:

(1) a first outer layer comprising an appearance layer, said first outer layer having a U-shaped configuration; and (2) a second layer comprising a reinforcement layer, said second layer having a U-shaped configuration, said first outer layer entirely covering said second layer; and (c) a lower element;

wherein said at least two layers further comprises a projection in at least one surface of said at least two layers to thereby form a visible projection on an outer ski surface, said projection comprising at least one additional element located between said first layer and said second layer, said at least one additional element comprising a reinforcement material;

wherein the appearance layer has a predetermined width and wherein the reinforcement element has a width substantially less than the width of the appearance layer.

2. The ski of claim 1, wherein the core is made of wood.

3. The ski of claim 1, wherein the ski has a predeterminate length and the outer layer extends substantially along the predeterminate length of the ski, and wherein the additional element projects upwardly with respect to an upper portion of the ski and has a length substantially less than the predeterminate length of the outer layer.

4. The ski of claim 1, further comprising at least one layer of filling material, said filling material being flowable under predetermined amounts of heat and pressure.

5. The ski of claim 4, wherein the additional element is located above the at least one layer of filling material.

6. The ski of claim 1, wherein the additional element comprises metal.

7. The ski of claim 1, wherein the additional element comprises laminated fiberglass.

8. The ski of claim 1, wherein the additional element comprises carbon.

9. The ski of claim 1, wherein the additional element comprises KEVLAR.

10. The ski of claim 1, wherein the core includes a synthetic foam.

11. The ski of claim 1, wherein the core includes an aluminum honeycomb.

12. The ski of claim 1, wherein the core includes a metallic tube.

13. The ski of claim 1, wherein the core includes a plastic tube.

14. The ski of claim 4, wherein the additional element is located directly adjacent said first layer and directly adjacent said second layer.

15. A ski comprising:

a core;

a casing comprising:

a first layer comprising an appearance layer having a U-shaped configuration, the appearance layer including an upper portion; and a second layer comprising a reinforcement layer, the appearance layer entirely covering the reinforcement layer;

a lower element, the core and the casing being positioned above the lower element; and a reinforcement element positioned above the reinforcement layer, the reinforcement element forming a visible upwardly extending projection in the upper portion of the appearance layer;

wherein the upper portion of the appearance layer has a predetermined width and wherein the reinforcement element has a width substantially less than the width of the upper portion of the appearance layer.

16. The ski of claim 15, wherein the visible upwardly extending projection has a generally horizontal upper surface.

17. The ski of claim 15, wherein the reinforcement element has a generally uniform thickness.

18. The ski of claim 15, wherein the reinforcement element has a thickness greater than that of the first layer.

19. The ski of claim 15, wherein the first layer comprises a thermo-flowable material, wherein the reinforcement element has a predetermined contour and wherein the reinforcement element is positioned directly beneath the first layer, whereby the projection comprises the predetermined contour of the reinforcement element.

20. The ski of claim 15, wherein the first layer comprises a thermoplastic material, wherein the reinforcement element has a predetermined contour and wherein the reinforcement element is positioned directly beneath the first layer, whereby the projection comprises the predetermined contour of the reinforcement element.

21. The ski of claim 15, wherein the first layer comprises a further sheet of material adjacent the appearance layer.

22. The ski of claim 15, wherein the reinforcement layer has a U-shaped configuration.

23. The ski of claim 15, wherein the additional element comprises metal.

24. The ski of claim 15, wherein the additional element comprises laminated fiberglass.

25. The ski of claim 15, wherein the additional element comprises carbon.

26. The ski of claim 15, wherein the additional element comprises KEVLAR.

* * * * *